US007503295B2

(12) United States Patent
Fujii et al.

(10) Patent No.: US 7,503,295 B2
(45) Date of Patent: Mar. 17, 2009

(54) ENGINE VALVE OPERATING SYSTEM

(75) Inventors: Noriaki Fujii, Wako (JP); Katsunori Nakamura, Wako (JP); Akiyuki Yonekawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/585,634

(22) PCT Filed: Jan. 13, 2005

(86) PCT No.: PCT/JP2005/000293

§ 371 (c)(1),
(2), (4) Date: Mar. 8, 2007

(87) PCT Pub. No.: WO2005/068794

PCT Pub. Date: Jul. 28, 2005

(65) Prior Publication Data

US 2007/0289565 A1 Dec. 20, 2007

(30) Foreign Application Priority Data

Jan. 16, 2004 (JP) ..... 2004-009395
Dec. 3, 2004 (JP) ..... 2004-350752

(51) Int. Cl.
*F01L 1/34* (2006.01)

(52) U.S. Cl. ..... 123/90.16; 123/90.39; 123/90.33

(58) Field of Classification Search ..... 123/90.16, 123/90.44, 90.34, 90.33, 90.35
See application file for complete search history.

(56) References Cited

U.S. PATENT DOCUMENTS

2006/0102118 A1* 5/2006 Fujii et al. ..... 123/90.16

FOREIGN PATENT DOCUMENTS

EP 1 548 240 6/2005

(Continued)

OTHER PUBLICATIONS

Supplementary European Search Report mailed Nov. 7, 2008 in corresponding application; 2 pages.

*Primary Examiner*—Zelalem Eshete
(74) *Attorney, Agent, or Firm*—Kratz, Quintos & Hanson, LLP

(57) ABSTRACT

An engine valve operating system is provided in which a rocker arm (63) linked and connected to an engine valve (19) and has a cam-abutting portion (65) to abut a valve operating cam (69) is turnably connected, via first and second connecting shafts (64, 66), to one end of a first link arm (61) turnably supported on an engine body (10) and one end of a second link arm (62) turnably supported by a displaceable movable shaft (68*a*). Also, oil supply means (58) which supply oil to the upper connecting shaft (64) of first and second connecting shafts (64, 66) are fixed to the engine body (10). This makes it possible to implement an engine valve operating system which is compact in size, ensures follow-up ability of the valve opening/closing operation, has a simple lubricating structure with a reduced number of parts, and ensures smooth valve operation while allowing the lift amount of the engine valve to be varied continuously.

6 Claims, 13 Drawing Sheets

FOREIGN PATENT DOCUMENTS

| | | |
|---|---|---|
| EP | 1 707 765 | 10/2006 |
| EP | 1 707 766 | 10/2006 |
| JP | 60-198317 | 10/1985 |
| JP | 60-167112 | 11/1985 |
| JP | 1-114917 | 8/1989 |
| JP | 1-179107 | 12/1989 |
| JP | 8-28235 | 1/1996 |
| JP | 8-74534 | 3/1996 |
| JP | 2004-36560 | 2/2004 |

* cited by examiner

HIGH VALVE LIFT

LOW VALVE LIFT

ENGINE VALVE OPERATING SYSTEM

TECHNICAL FIELD

The present invention relates to an engine valve operating system equipped with a variable valve lift mechanism which continuously varies the lift amount of an engine valve, namely an intake valve or exhaust valve.

BACKGROUND ART

A valve operating system in which one end of a push rod is fitted to one end of a rocker arm having a valve abutment part abutting to an engine valve at the other end side and a link mechanism is provided between the other end of the push rod and a valve operating cam in order to continuously change the amount of lift of the engine valve is already known by Patent Document 1.

However, in the engine valve operating system disclosed in the above-described Patent Document 1, it is necessary to ensure a comparatively large space to dispose a link mechanism and the push rod therein, between the valve operating cam and the rocker arm, and therefore, the valve operating system becomes large in size. In addition, a driving force from the valve operating cam is transmitted to the rocker arm via the link mechanism and the push rod, and therefore, it is difficult to say follow-up ability of the rocker arm to the valve operating cam, namely, follow-up ability of opening and closing operation of the engine valve is excellent.

Thus, the applicant already proposes a valve operating system of the internal combustion engine in which one end portions of a first and second link arm are rotatably connected to a rocker arm, the other end portion of the first link arm is rotatably supported at an engine body, and the other end portion of the second link arm is displaced by drive means in Patent Document 2. According to the valve operating system, it is possible to make the valve operating system compact and it is also possible to ensure excellent follow-up ability to the valve operating cam by directly transmitting the power from the valve operating cam to the rocker arm.

Patent Document 1:

Japanese Patent Application Laid-open No. 8-74534

Patent Document 2:

Japanese Patent Application Laid-open No. 2004-36560

DISCLOSURE OF THE INVENTION

Problems to be Solved by the Invention

In the proposed valve operating system, the connecting portions of the first and second link arms with the rocker arm must be lubricated individually to ensure smooth valve operation. However, supplying oil individually to both the connecting portions will not only complicate the configuration, but also increase the number of parts.

The present invention has been made in view of the above circumstances and has an object to provide an engine valve operating system which is compact in size, ensures follow-up ability of the valve opening/closing operation, has a simple lubricating structure with a reduced number of parts, and ensures smooth valve operation while allowing the lift amount of the engine valve to be varied continuously.

Means for Solving the Problems

To achieve the above object, according to a first aspect and feature of the present invention, there is provided an engine valve operating system, comprising a rocker arm which has a valve connecting portion linked and connected to an engine valve and a cam-abutting portion to abut a valve operating cam; a first link arm with one end turnably connected to the rocker arm via a first connecting shaft and the other end turnably supported at a fixed position on an engine body; a second link arm with one end turnably connected to the rocker arm via a second connecting shaft disposed side by side in a vertical arrangement with the first connecting shaft and the other end turnably supported by a movable shaft which is displaceable; drive means connected to the movable shaft, being ready to displace the movable shaft in order to vary a lift amount of the engine valve continuously; and oil supply means which is fixed to the engine body and supplies oil to the upper one of the first and second connecting shafts.

According to a second aspect and feature of the present invention in addition to the first aspect, there is provided the engine valve operating system, wherein the rocker arm is equipped with a support portion formed into a substantially U shape so as to sandwich a roller which is the cam-abutting portion from opposite sides; the one end of the first link arm is turnably connected to the support portion via the first connecting shaft which supports the roller; and the oil supply means is disposed on the engine body so as to supply oil to a mating surface between the first link arm and the support portion.

According to a third aspect and feature of the present invention in addition to the first aspect, there is provided the engine valve operating system, wherein the oil supply means is disposed on a cam holder installed on the engine body so as to rotatably support a camshaft on which the valve operating cam is mounted.

According to a fourth aspect and feature of the present invention in addition to any of the first to third aspects, there is provided the engine valve operating system, wherein the oil supply means which is formed of oil jets, each with a nozzle hole provided at the tip of a pipe, is disposed on opposite sides of each cylinder on the engine body.

According to a fifth aspect and feature of the present invention in addition to any of the first to third aspects, there is provided the engine valve operating system, wherein the oil supply means which is formed of the oil jet with the nozzle hole provided at the tip of the pipe is disposed on one side of each cylinder on the engine body.

EFFECT OF THE INVENTION

With the arrangement of the first aspect, it is possible to vary the lift amount of the engine valve continuously by displacing the movable shaft continuously. Also, since the one ends of the first and second link arms are turnably connected directly to the rocker arm, it is possible to decrease the space for placing the link arms, thereby reducing the size of the valve operating system. Besides, since the power from the valve operating cam is transmitted directly to the cam-abutting portion of the rocker arm, it is possible to ensure excellent follow-up ability to the valve operating cam. Furthermore, since the first ends of the first and second link arms are turnably connected to the rocker arm via the first and second connecting shafts disposed side by side in a vertical arrangement, and oil is supplied to the upper one of the first and second connecting shafts, the oil which has lubricated between the rocker arm and the upper one of the first and second link arms flows downward to lubricate between the rocker arm and the lower one of the link arms. This makes it possible to lubricate the connecting portions between the rocker arm and both the first and second link arms using a simple lubricating structure with a reduced number of parts, and thereby ensure smooth valve operation.

With the arrangement of the second aspect, it is possible to rotatably support the roller on the support portion of the rocker arm, and thereby reduce the size of the entire rocker arm including the roller. Also, the second aspect makes it possible to lubricate the journals of the roller.

With the arrangement of the third aspect, it is possible to supply oil with sufficient amount and sufficient high pressure from the oil supply means using an oil path for lubricating between the camshaft and cam holders.

With the arrangement of the fourth aspect, it is possible to supply oil to lubrication points from the tips of oil jets disposed on opposite sides of each cylinder.

With the arrangement of the fifth aspect, it is possible to supply oil to lubrication points using a reduced number of oil jets.

DESCRIPTION OF REFERENCE NUMERALS AND CHARACTERS

Figure 1:
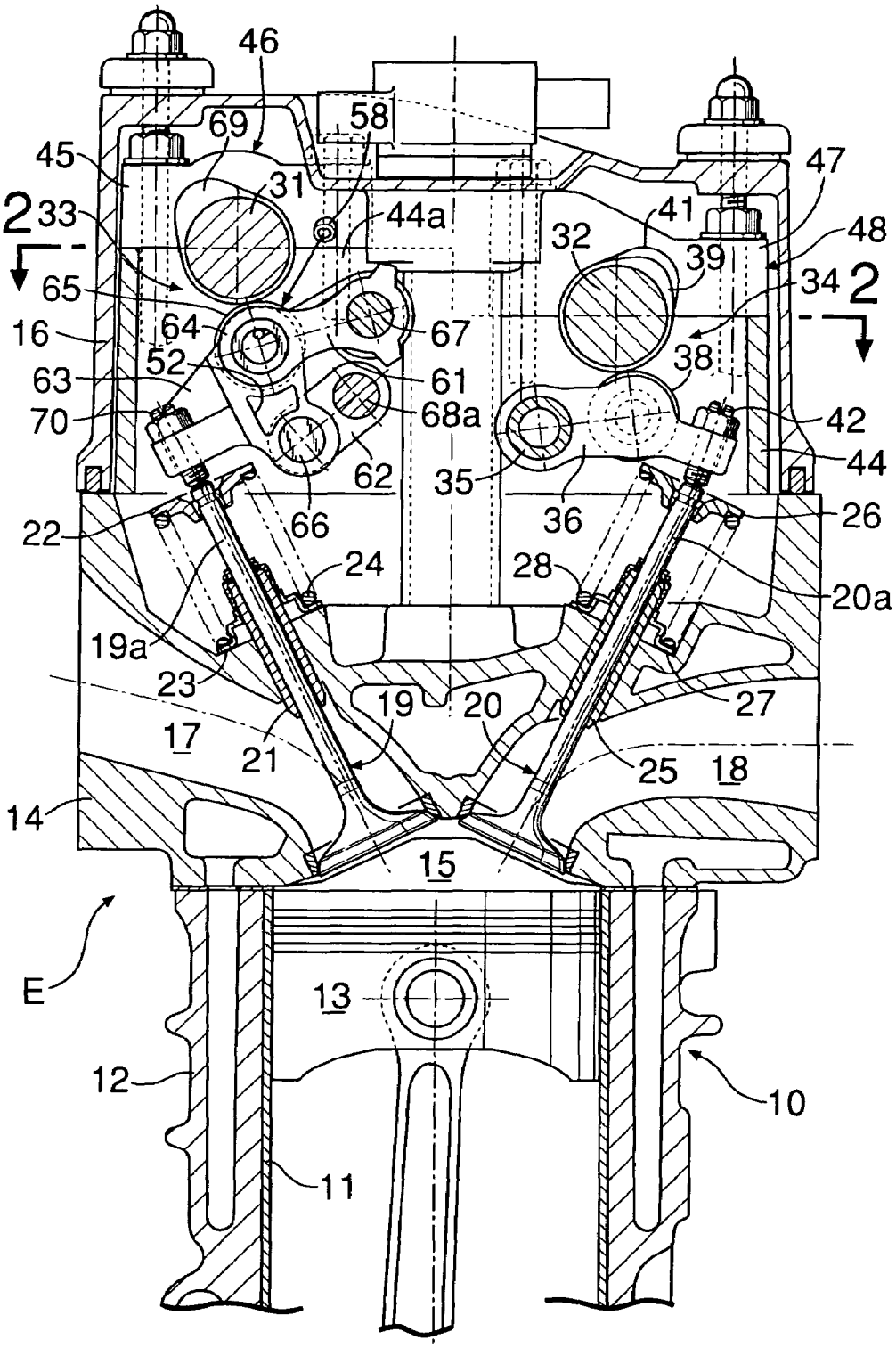
FIG. 1 is a partial longitudinal sectional view of an engine according to a first embodiment taken along line 1-1 in FIG. 2. (Embodiment 1)

10 . . . Engine body
19 . . . Intake valve serving as an engine valve
31 . . . Camshaft
46 . . . Cam holder
58 . . . Oil jet serving as oil supply means
58*a* . . . Pipe
58*b* . . . Nozzle hole
61 . . . First link arm
62 . . . Second link arm
63 . . . Rocker arm
63*a* . . . Valve connecting portion
63*b* . . . Support portion
64 . . . First connecting shaft
65 . . . Roller serving as a cam-abutting portion
66 . . . Second connecting shaft
68*a* . . . Movable shaft
69 . . . Valve operating cam
72 . . . Actuator motor serving as drive means
E . . . Engine

BEST MODES FOR CARRYING OUT THE INVENTION

Mode for carrying out the present invention will be described below with reference to embodiments of the present invention shown in the accompanying drawings.

Embodiment 1

FIGS. 1 to 11 show a first embodiment of the present invention. First, referring to FIG. 1, an engine body 10 of an in-line multi-cylinder engine E comprises a cylinder block 12 with cylinder bores 11 . . . in the interior, a cylinder head 14 joined to a top face of the cylinder block 12, and a head cover 16 joined to a top face of the cylinder head 14. Pistons 13 . . . are slidably fitted in the cylinder bores 11 . . . . Combustion chambers 15 . . . facing tops of the pistons 13 . . . are formed between the cylinder block 12 and cylinder head 14.

The cylinder head 14 is equipped with intake ports 17 . . . and exhaust ports 18 . . . which can be communicated with combustion chambers 15 . . . . The intake ports 17 are opened and closed by a pair of intake valves 19 . . . which are engine valves while the exhaust ports 18 are opened and closed by a pair of exhaust valves 20 . . . . Each intake valve 19 has a stem 19*a* slidably fitted in a valve guide 21 provided in the cylinder head 14, and is biased in a valve closing direction by a valve spring 24 installed between a spring seat 22 provided at the upper end of the stem 19*a* and a spring seat 23 abutted by the cylinder head 14. Each exhaust valve 20 has a stem 20*a* slidably fitted in a valve guide 25 provided in the cylinder head 14 and is biased in a valve closing direction by a valve spring 28 installed between a spring seat 26 provided at the upper end of the stem 20*a* and a spring seat 27 abutted by the cylinder head 14.

Figure 2:
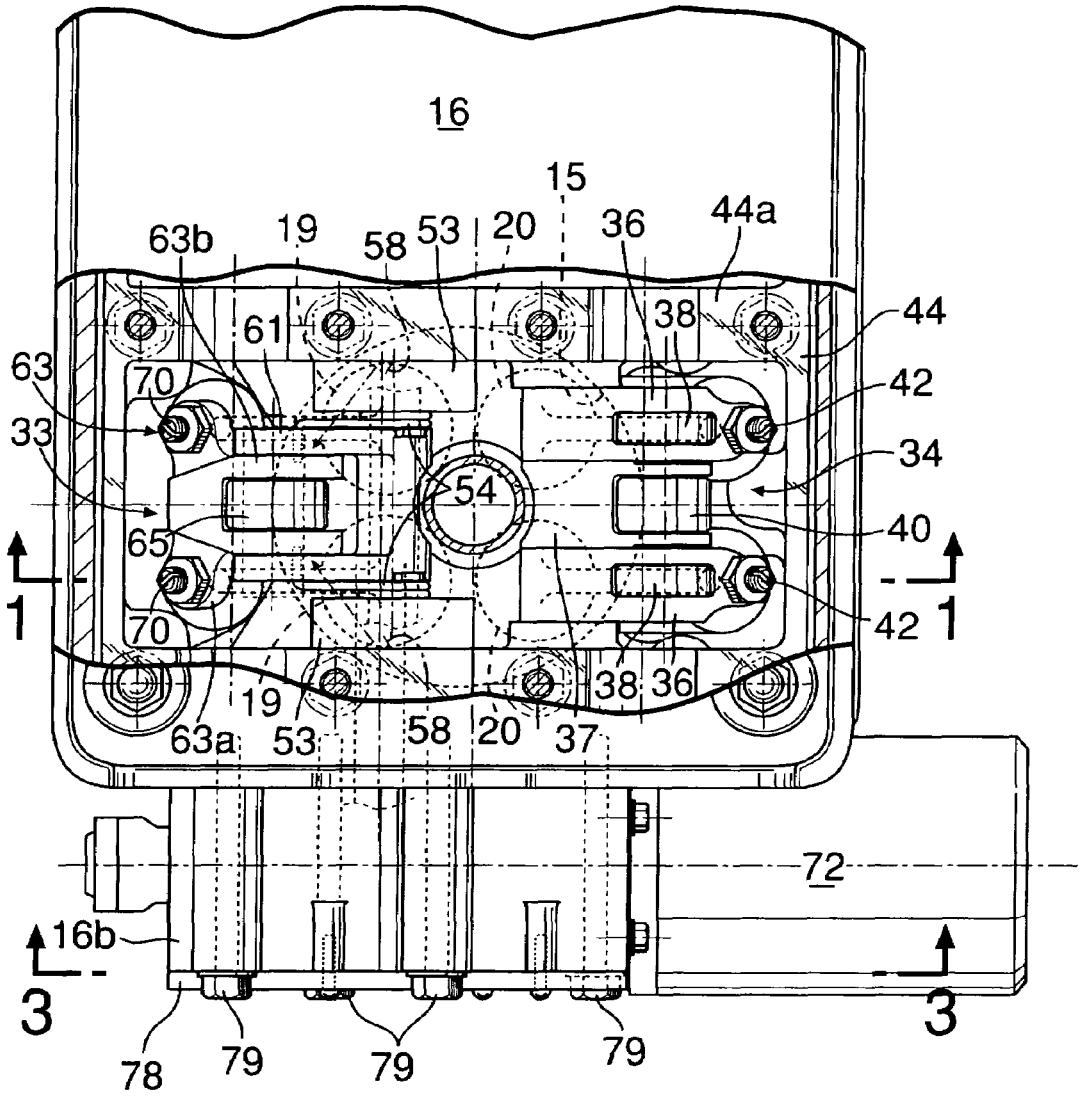
FIG. 2 is a sectional view taken along line 2-2 in FIG. 1. (Embodiment 1)

Referring also to FIG. 2, the cylinder head 14 integrally comprises a holder 44 which has supporting walls 44*a* . . . placed on both sides of each cylinder. Caps 45 . . . and 47 . . . are fastened tightly to each supporting wall 44*a* . . . to form an intake cam holder 46 . . . and exhaust cam holder 48 . . . in conjunction. Consequently, an intake camshaft 31 is rotatably supported by the intake cam holders 46 . . . while an exhaust camshaft 32 is rotatably supported by the exhaust cam holders 48 . . . . The intake valves 19 . . . are driven by the intake camshaft 31 via variable valve lifting mechanism 33 and the exhaust valves 20 . . . are driven by the exhaust camshaft 32 via variable valve timing/lifting mechanism 34.

The variable valve timing/lifting mechanism 34 which drives the exhaust valves 20 . . . is well-known, and will only be outlined here. A pair of low-speed rocker arms 36, 36 and one high-speed rocker arm 37 are pivotably supported at their first ends on an exhaust rocker shaft 35 supported by the supporting wall 44*a* . . . in the exhaust cam holder 48. Rollers 38, 38 axially supported in intermediate parts of the low-speed rocker arms 36, 36 are abutted by two low speed cams 39, 39 mounted on the exhaust camshaft 32 while a roller 40 axially supported in an intermediate part of the high-speed rocker arm 37 is abutted by a high-speed cam 41 mounted on the exhaust camshaft 32. Tappet screws 42 . . . which abut the upper end of stem 20*a* . . . of the exhaust valves 20 . . . are screwed into the second ends of the low speed rocker arms 36 in such a way as to allow their advance/retract position to be adjusted.

The low speed rocker arms 36, 36 and the high speed rocker arm 37 can be connected and disconnected by hydraulic control. When the engine E is running at low speed, if the low speed rocker arms 36, 36 and the high speed rocker arm 37 are disconnected, the low speed rocker arms 36, 36 are driven by the corresponding low speed cams 39, 39 and consequently the exhaust valves 20 . . . are opened and closed with a low valve lift and a low opening angle. On the other hand, when the engine E is running at high speed, if the low speed rocker arms 36, 36 and the high speed rocker arm 37 are connected, the high speed rocker arm 37 is driven by the corresponding high speed cam 41 and consequently the exhaust valves 20 . . . are opened and closed with a high valve lift and a high opening angle by the low speed rocker arms 36, 36 coupled to the high speed rocker arm 37. In this way, the valve lift and valve timing of the exhaust valves 20 . . . are controlled at two levels by the variable valve timing/lifting mechanism 34.

Now, the structure of the variable valve lift mechanism 33 will be described by referring also to FIG. 3 to FIG. 7. The variable valve lift mechanism 33 comprises a rocker arm 63 which has a roller 65 serving as a cam-abutting portion to abut a valve operating cam 69 mounted on the intake camshaft 31, first link arm 61 whose first end is turnably connected to the rocker arm 63 and whose second end is turnably supported at a fixed position on an engine body 10, and second link arm 62 whose first end is turnably connected to the rocker arm 63 and whose second end is turnably supported by a movable shaft 68*a* which is displaceable.

A valve connecting portion 63*a* into which tappet screws 70 with adjustable advance/retract positions are screwed is installed on the first end of the rocker arm 63, where the tappet screws 70, 70 abut the upper ends of stems 19*a* . . . of a pair of intake valves 19 . . . from above. The second end of the rocker arm 63 is formed into a U shape in such a way as to open to the side opposite to the intake valves 19 . . . . A first support portion 63*b* turnably connected with the first end of the first link arm 61 and a second support portion 63*c* turnably connected with the first end of the second link arm 61 are installed on the second end of the rocker arm 63 in such a way that the second support portion 63*c* is placed below the first support portion 63*b*. The roller 65 which is in rolling contact with the valve operating cam 69 of the intake camshaft 31 is held in the first support portion 63*b* which has a U shape. It is axially supported by the first support portion 63*b* coaxially with the connecting portion on the first end of the first link arm 61.

The rocker arm 63 is configured such that the valve connecting portion 63*a* is broader in width along the axial direction of the valve operating cam 69 than the other part while the first support portion 63*b* and second support portion 63*c* have the same width.

The first link arm 61 is formed into a U shape with a pair of first connecting portions 61*a* which sandwich the rocker arm 63 from both sides, a cylindrical fixed support portion 61*b*, and a pair of arm portions 61*c* which link the first connecting portions 61*a* and the fixed support portion 61*b*.

The first connecting portions 61*a* at a first end of the first link arm 61 are turnably connected to the first support portion 63*b* at the second end of the rocker arm 63 via a cylindrical first connecting shaft 64 fixed in a first connecting hole 49 provided in the first support portion 63*b*. The roller 65 is also axially supported by the first support portion 63*b* via the first connecting shaft 64. An outer flank of that part of the first support portion 63*b* which opposes the intake camshaft 31 overlaps with outer flanks of the first connecting portions 61*a* of the first link arm 61 as viewed laterally, forming an arc around the axis of the first connecting shaft 64.

The second link arm 62 placed below the first link arm 61 has a first connecting portion 62*a* at the first end, and a movable support portion 62*b* at the second end. The second connecting portion 62*a* is held in the second support portion 63*b* which has a U shape. The second support portion 63*c* has a second connecting hole 50 which runs horizontally, being aligned vertically—i.e., in the opening/closing direction of the intake valves 19 . . . —with the first connecting hole 49 of the first support portion 63*b*. The second connecting portion 62*a* is turnably connected to the second support portion 63*c* via a second connecting shaft 66 fixed in the second connecting hole 50.

The first end of the rocker arm 63 is coupled to the pair of intake valves 19 . . . , and the valve operating cam 69 in abutment with the roller 65 is installed in an upper part the second end of the rocker arm 63. Also, the first connecting portions 61*a*, 61*a* on the first end of the first link arm 61 and second connecting portion 62*a* at the first end of the second link arm 62 located below the first link arm 61 are vertically arranged in parallel and relatively turnably connected to the second end of the rocker arm 63.

The rocker arm 63 integrally comprises a pair of connecting walls 63*d* . . . which link the U-shaped first and second support portions 63*b* and 63*c*. If a tangent line L is drawn to outer edges of the first and second connecting holes 49 and 50 on the side nearer to the intake valves 19 . . . , the connecting walls 63*d* are formed such that at least part of the connecting walls 63*d* . . . are located on the opposite side of the tangent line L from the two intake valves 19 . . . to link the first support portion 63*b* with the second support portion 63*c*.

Besides, recesses 51 . . . are formed in the connecting walls 63*d* . . . in such a way as to face the movable shaft 68*a* when the movable support portion 62*b* on the second end of the second link arm 62 is at the closest point to the rocker arm 63. Furthermore, a narrow portions 52 . . . are formed on the connecting walls 63*d* . . . in such away as to be recessed inward, for example.

The fixed support portion 61*b* on the second end of the first link arm 61 is turnably supported by a fixed spindle 67 supported statically by supporting walls 44*a* . . . which constitute lower parts of intake cam holders 46 . . . provided for the engine body 10.

Figure 6:
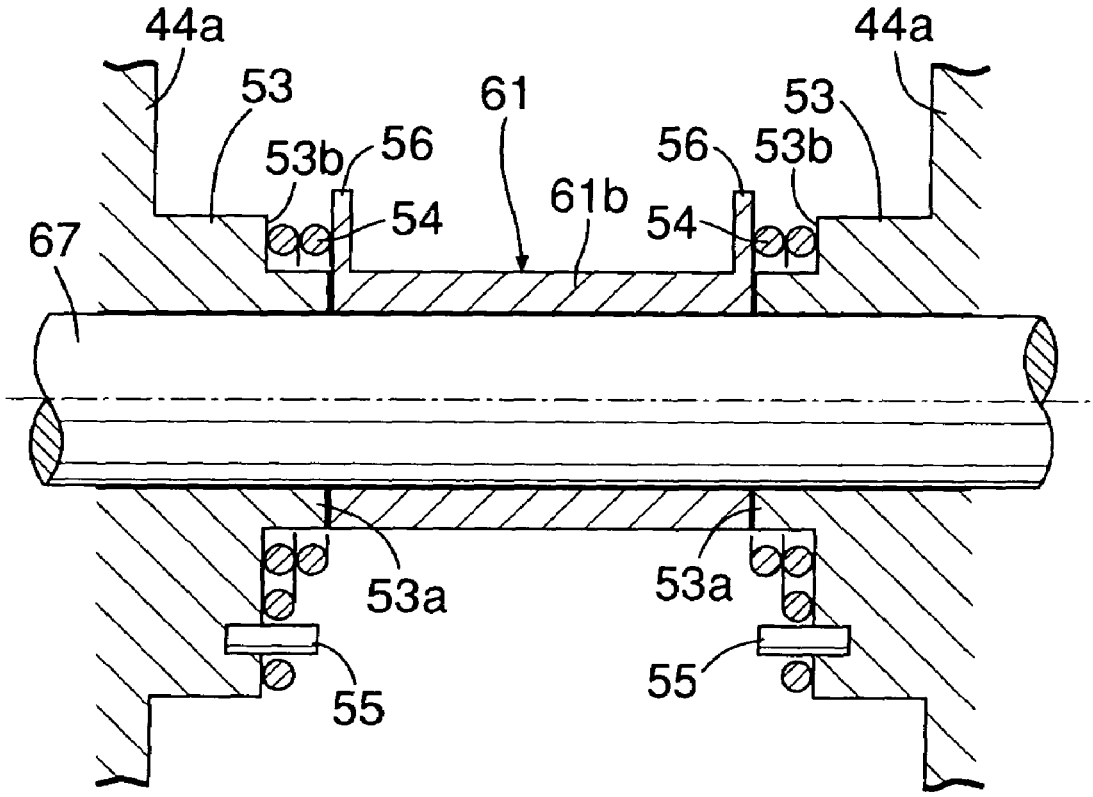
FIG. 6 is an enlarged sectional view taken along line 6-6 in FIG. 4. (Embodiment 1)
Figure 7:
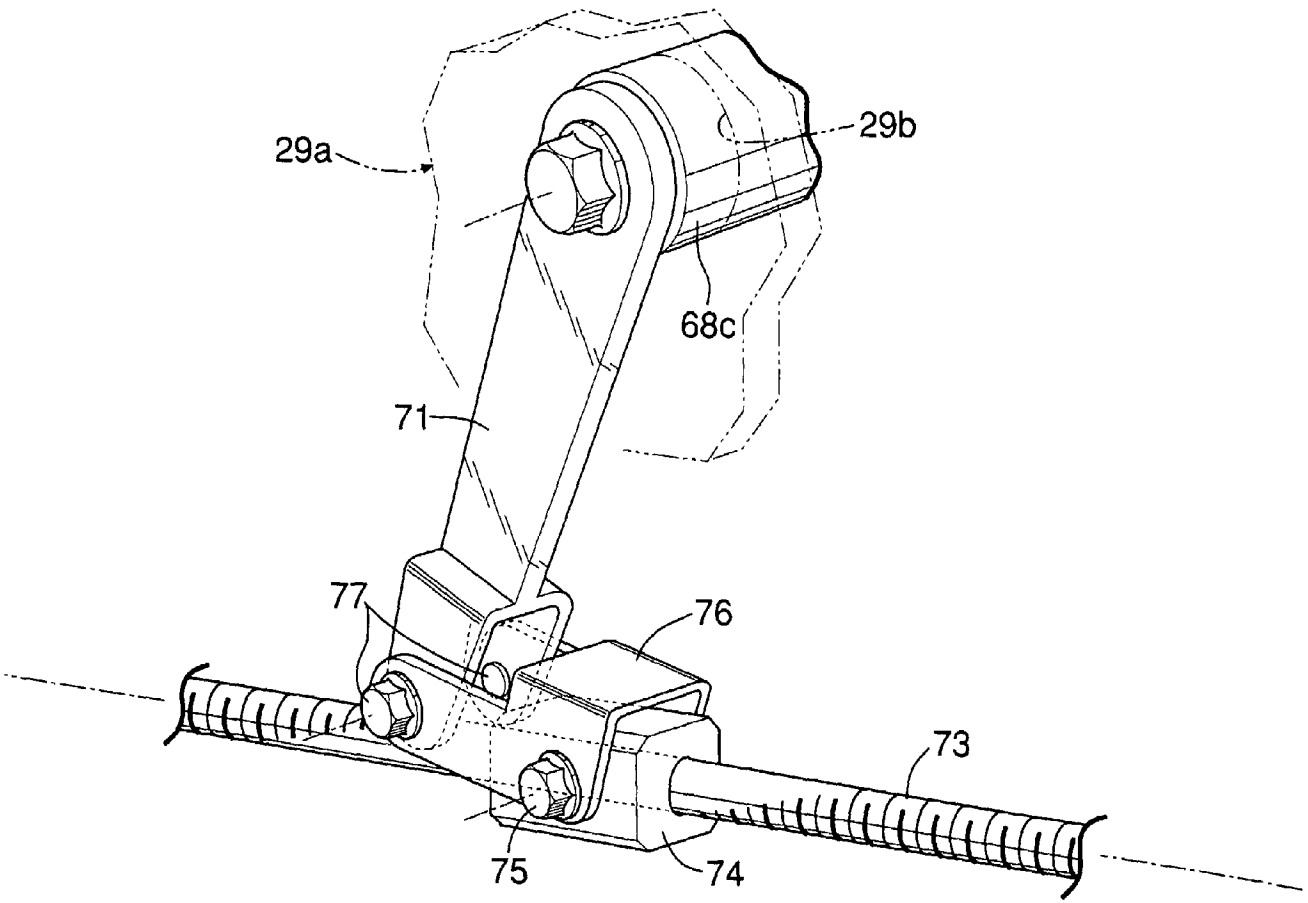
FIG. 7 is a view along arrow 7 in FIG. 3. (Embodiment 1)

Referring specifically to FIG. 6, a pair of supporting bosses 53, 53 are mounted integrally to the supporting walls 44*a* . . . in a protruding condition so as to sandwich the fixed support portion 61*b* of the first link arm 61 from both sides in the axial direction. The supporting bosses 53 . . . are equipped with small-diameter shaft portions 53*a* . . . which can come into sliding contact with opposite end faces of the fixed support portion 61*b*, and shoulders 53*b* . . . which face—but stay clear of—opposite end faces of the fixed support portion 61*b* in such a way as to enclose the base end of the small-diameter shaft portions 53*a* . . . . The fixed spindle 67 is supported statically by the supporting bosses 53 . . . in such a way as to penetrate the small-diameter shaft portions 53*a* . . . coaxially.

The intake valves 19 . . . are biased in the valve closing direction by valve springs 24 . . . . When the intake valves 19 . . . spring-biased in the valve closing direction are driven in the valve closing direction by the rocker arm 63, the roller 65 of the rocker arm 63 is held in abutment with the valve operating cam 69 by the valve springs 24 . . . . However, when the intake valves 19 . . . are closed, the spring force of the valve springs 24 . . . does not act on the rocker arm 63, and thus the roller 65 leaves the valve operating cam 69. This may reduce control accuracy of the valve lift amounts when the intake valves 19 . . . are slightly opened. The rocker arm 63 is biased by rocker arm bias springs 54 . . . separate from the valve springs 24 . . . in such a direction as to abut the roller 65 against the valve operating cam 69.

The rocker arm bias springs 54 . . . are coiled tortional springs which surround one of the fixed spindle 67 and the movable shaft 68*a* which turnably support the fixed support portion 61*b* and movable support portion 62*b* at the second ends of the first and second link arms 61 and 62. According to this example, the rocker arm bias springs 54 . . . are installed between the engine body 10 and rocker arm 63 so as to surround the fixed spindle 67 via the small-diameter shaft portions 53*a* . . . of the supporting bosses 53 . . . . That is, first ends of the rocker arm bias springs 54 . . . which surround the small-diameter shaft portions 53*a* . . . are engaged with latch pins 55 implanted in the shoulders 53*b* . . . of supporting bosses 53 . . . while the second ends of the rocker arm bias springs 54 . . . are inserted in, and engaged with, the hollow first connecting shaft 64 which move together with the rocker arm 63.

The fixed support portion 61*b* on the second end of the first link arm 61 is formed into a cylindrical shape with its outer circumference placed within the outer circumference of the rocker arm bias springs 54 . . . —wound into coils—when viewed laterally. At axially opposite ends of the fixed support portion 61*b*, a plurality of protrusions, for example, a pair of protrusions 56 and 57, spaced circumferentially from each other, are installed to prevent the rocker arm bias springs 54 . . . from falling toward the fixed support portion 61*b*. The protrusions 56 and 57 are kept clear of a working area of the second link arm 62.

The oil jets 58 . . . serving as oil supply means are fixed to the engine body 10 to supply oil to the upper one of the first and second connecting shafts 64 and 66 arranged one above the other so as to connect the first connecting portions 61*a* . . . and second connecting portion 62*a* on the first ends of the first and second link arms 61 and 62 to the second end of the rocker arm 63. Each oil jet 58 has a nozzle hole 58*b* at the tip of a pipe 58*a*. According to this example, the oil jets 58 . . . which supply oil to the first connecting shaft 64, the upper one of the first and second connecting shafts 64 and 66, are fixed to caps 45 . . . of the intake cam holders 46 . . . installed on the engine body 10. According to this example, the oil jets 58 . . . are installed on the caps 45 . . . on the engine body 10, on both sides of the cylinder, with the tips of the pipes 58*a* . . . placed inside the rim of a combustion chamber 15 when viewed on a projection to a plane orthogonal to the axis of the cylinder (plane parallel to the paper in FIG. 2).

The first support portion 63*b* formed into an appropriate U shape in such a way as to hold the roller 65 from both sides is installed in an upper part the second end of the rocker arm 63. The first connecting portions 61*a* . . . at the first end of the first link arm 61 are turnably connected to the first support portion 63*b* at the second end of the rocker arm 63 via the first connecting shaft 64 which supports the roller 65. The oil jets 58 . . . are disposed on the caps 45 . . . to supply oil to the mating surface between the first connecting portions 61*a* . . . of the first link arm 61 and the first support portion 63*b*.

The movable shaft 68*a* which rotatably supports the movable support portion 62*b* which the second link arm 62 has on its other end is installed on a crank member 68. The crank member 68 has the movable shaft 68*a* and a spindle 68*c* mounted on opposite ends of a connection plate 68*b* at right angles to the connection plate 68*b* and protruding in mutually opposite directions, where the connection plate 68*b* is placed in a plane parallel to a working plane of the second link arm 62. The spindle 68*c* is rotatably supported in a support hole 16*a* provided in the head cover 16 of the engine body 10.

Figure 4:
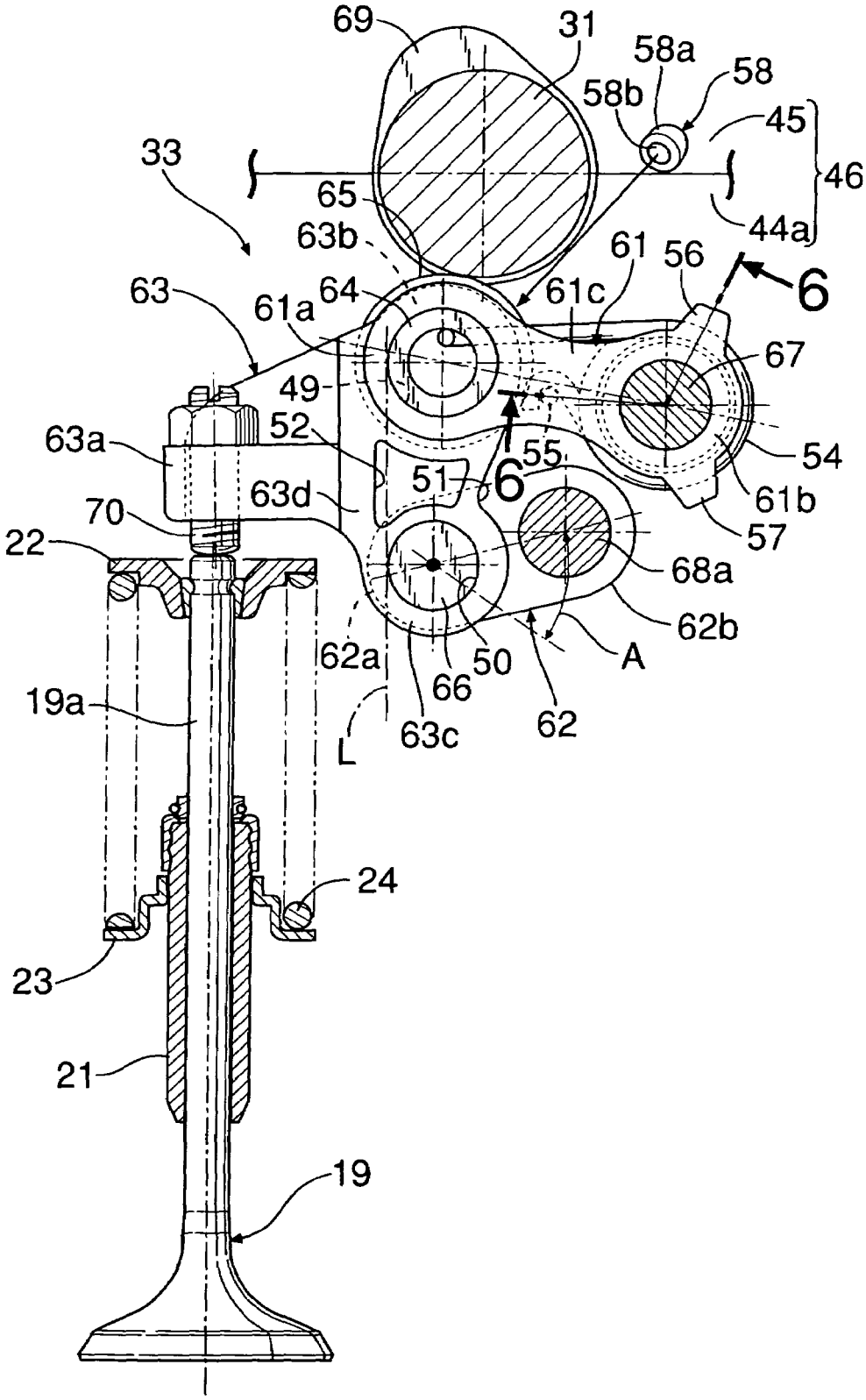
FIG. 4 is a side view of a variable valve lift mechanism. (Embodiment 1)
Figure 5:
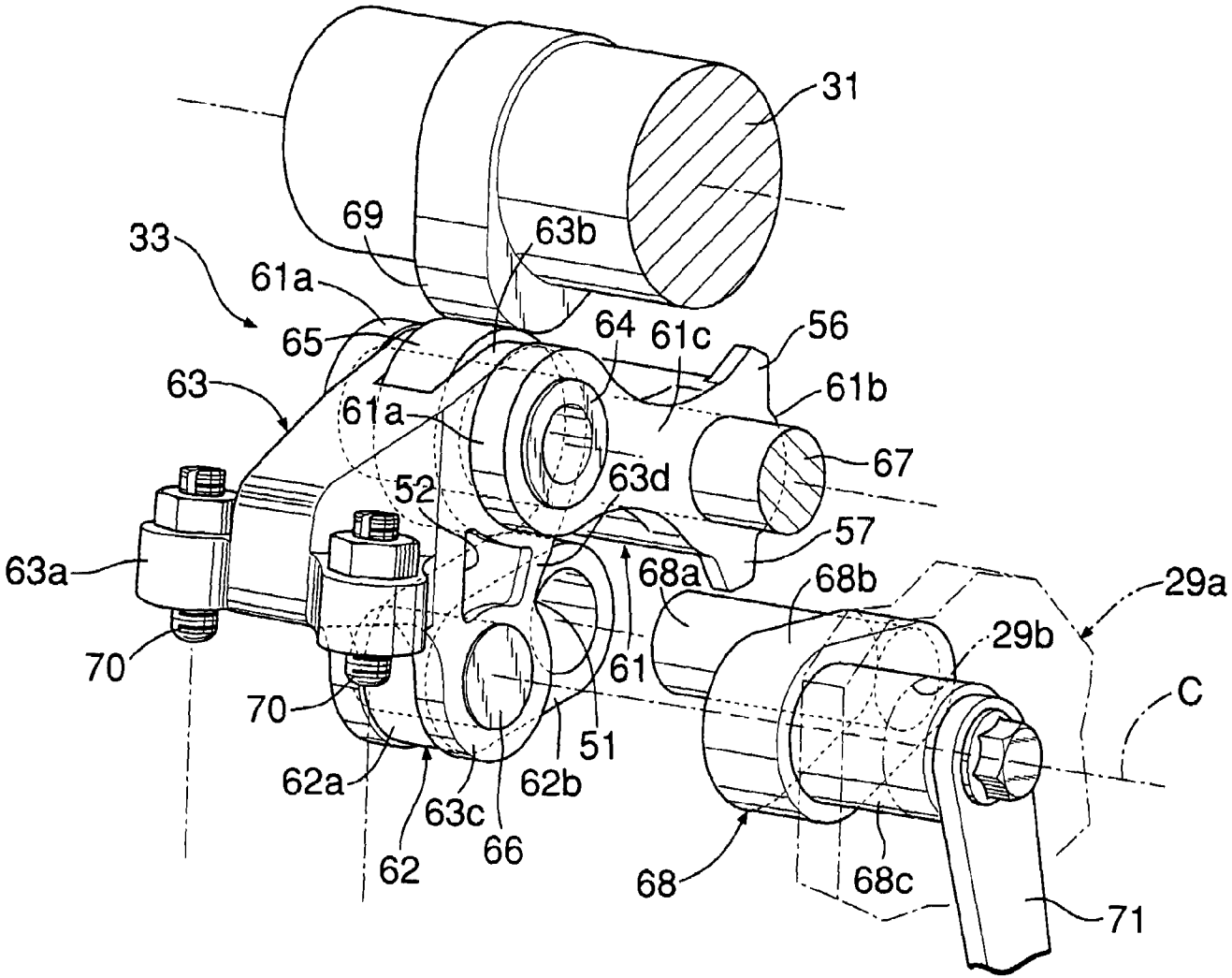
FIG. 5 is an exploded perspective view of the variable valve lift mechanism. (Embodiment 1)

When the rocker arm 63 is at the raised position shown in FIG. 4, that is, when the intake valves 19 . . . are in a closed state, the spindle 68*c* of the crank member 68 is placed coaxially with an axis C of the second connecting shaft 66, which pivotably supports the lower part of the rocker arm 63 (see FIG. 5). Therefore, when the crank member 68 swings around the axis of the spindle 68*c*, the movable support shaft 68*a*moves on an arc A (see FIG. 4) which has its center at the spindle 68*c*.

The spindle 68*c* of the crank member 68 sticks out from the support hole 16*a* in the head cover 16. A control arm 71 is fixed to the tip of the spindle 68*c* and driven by an actuator motor 72 mounted on an outer wall of the cylinder head 14 and serving as drive means. That is, a nut member 74 meshes with a threaded shaft 73 rotated by the actuator motor 72, a first end of a connecting link 76 is pivotably supported on the nut member 74 via a pin 75, and the second end is connected to the control arm 71 via pins 77, 77. Therefore, when the actuator motor 72 is operated, the nut member 74 moves along the rotating threaded shaft 73, the crank member 68 is caused to swing around the spindle 68*c* by the control arm 71 connected to the nut member 74 via the connecting link 76, and consequently the movable support shaft 68*a* moves between the position shown in FIG. 8A and the position shown in FIG. 8B.

A rotational angle sensor 80 such as a rotary encoder is installed on an outer wall surface of the head cover 16 with a first end of a sensor arm 81 fixed to the tip of a sensor shaft 80*a*. A guide groove 82 is provided in the control arm 71 linearly extending along its length, and a connecting shaft 83 mounted on the second end of the sensor arm 81 is slidably fitted in the guide groove 82.

The threaded shaft 73, nut member 74, pin 75, connecting link 76, pins 77, 77, control arm 71, rotational angle sensor 80, sensor arm 81, and connecting shaft 83 are housed within wall portions 14*a* and 16b sticking out from flanks of the cylinder block 14 and head cover 16. A cover 78 which covers end faces of the wall portions 14*a* and 16*b* is fixed to the wall portions 14*a* and 16*b* with bolts 79.

Figure 3:
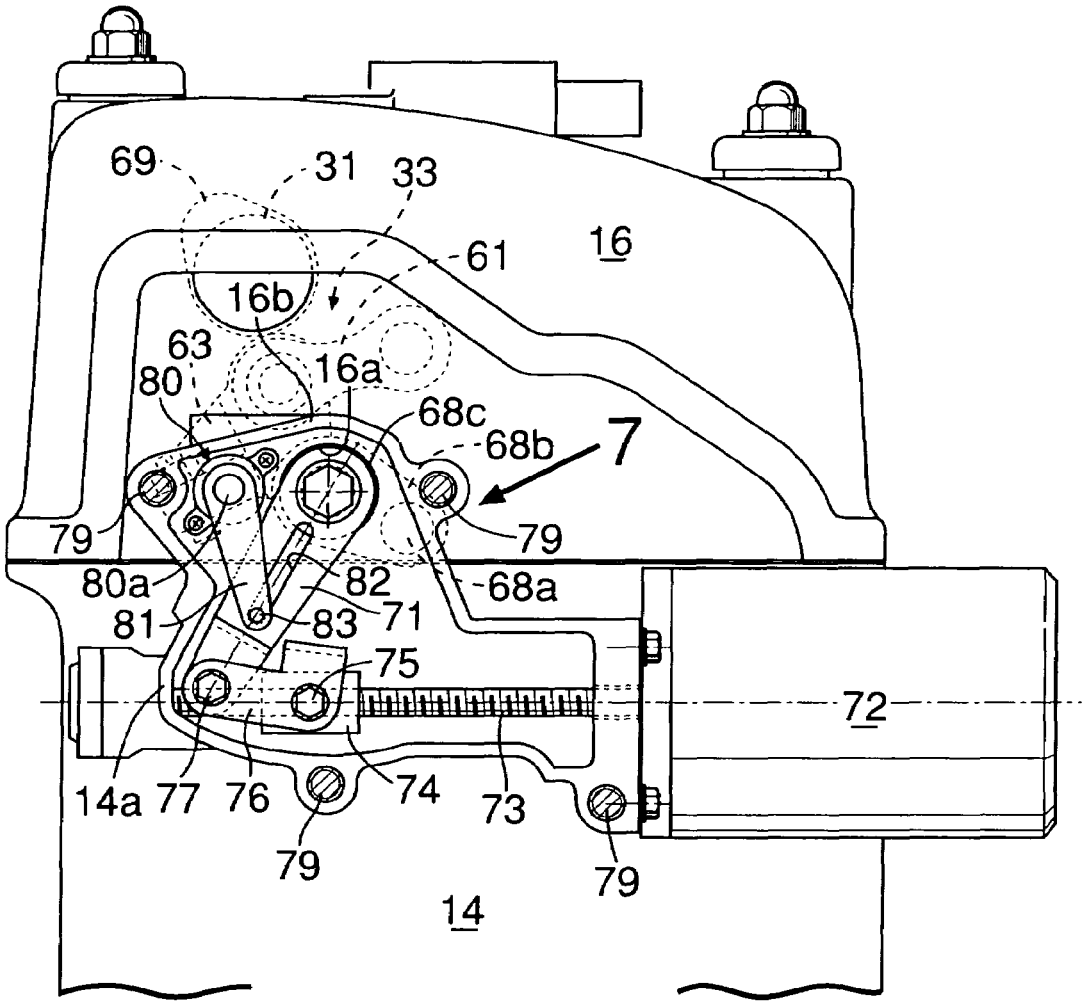
FIG. 3 is a view taken along line 3-3 in FIG. 2. (Embodiment 1)
Figure 8A:
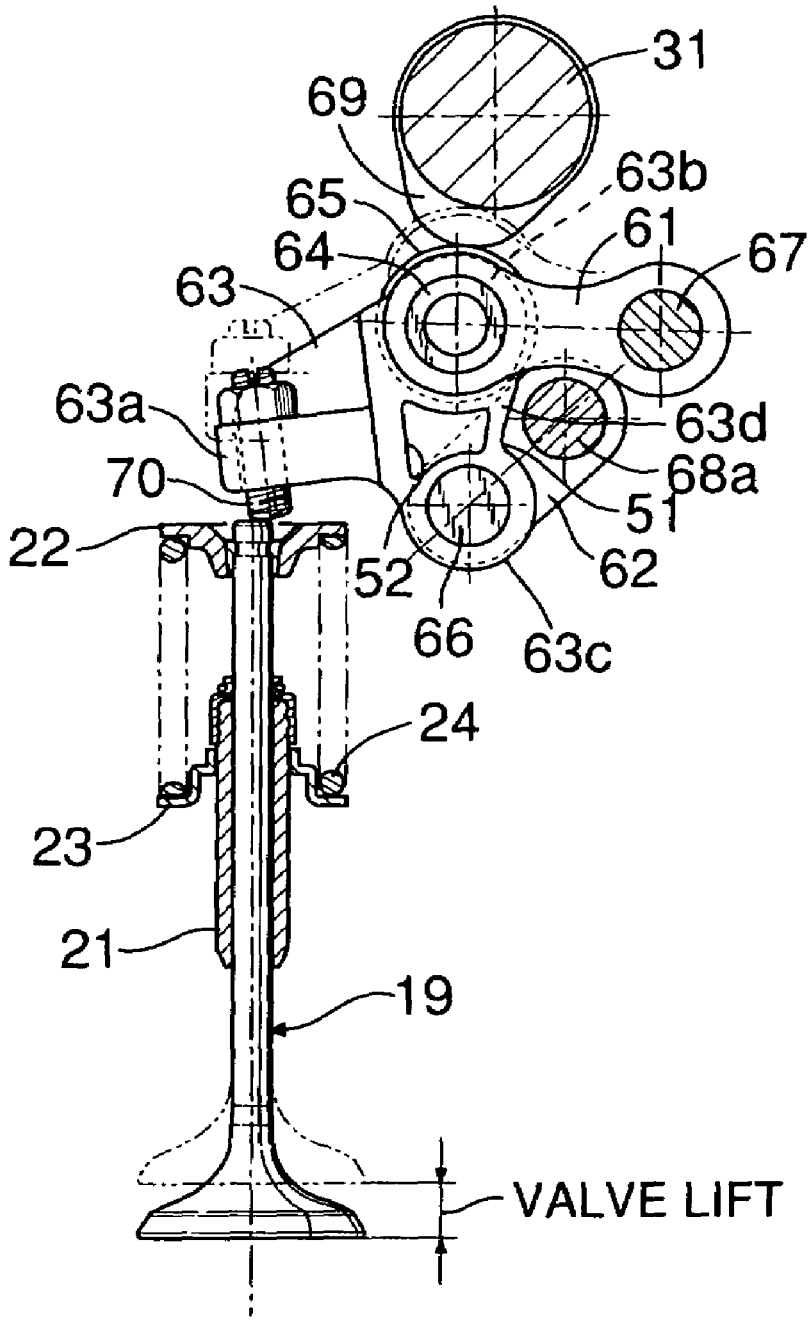
FIG. 8A is an explanatory diagram illustrating operation of the variable valve lift mechanism when a valve lift amount is high. (Embodiment 1)

In the variable valve lifting mechanism 33, when the control arm 71 is turned counterclockwise by the actuator motor 72 from the position indicated by the solid line in FIG. 3, the crank member 68 (see FIG. 5) connected to the control arm 71 turns counterclockwise and the movable support shaft 68*a*of the crank member ascends as shown in FIG. 8A. When the valve operating cam 69 mounted on the intake camshaft 31 pushes the roller 65 in this state, a four-bar link joining the fixed spindle 67, first connecting shaft 64, second connecting shaft 68, and movable support shaft 68*a* deforms, causing the rocker arm 63 to swing downward from the chain-line position to the solid-line position, causing the tappet screws 70, 70 to push the stems 19*a* . . . of the intake valves 19, and thereby opening the intake valves 19 . . . with a high valve lift.

Figure 8B:
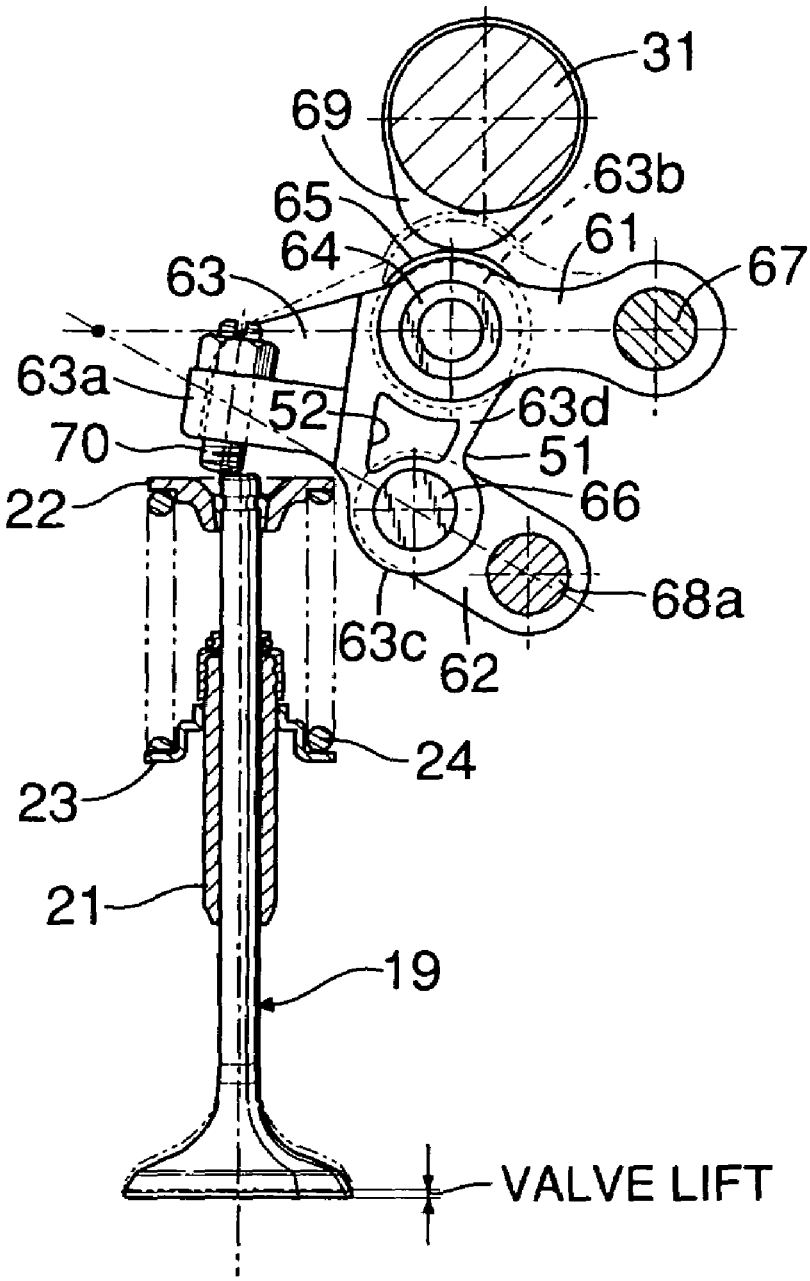
FIG. 8B is an explanatory diagram illustrating operation of the variable valve lift mechanism when the valve lift amount is low. (Embodiment 1)

When the control arm 71 is turned to the solid-line position in FIG. 3 by the actuator motor 72, the crank member 68 connected to the control arm 71 turns clockwise and the movable support shaft 68*a* of the crank member 68 descends as shown in FIG. 8B. When the valve operating cam 69 mounted on the intake camshaft 31 pushes the roller 65 in this state, the four-bar link deforms, causing the rocker arm 63 to swing downward from the chain-line position to the solid-line position, causing the tappet screws 70, 70 to push the stems 19*a* of the intake valves 19 . . . , and thereby opening the intake valves 19 . . . with a low valve lift.

Figure 9:
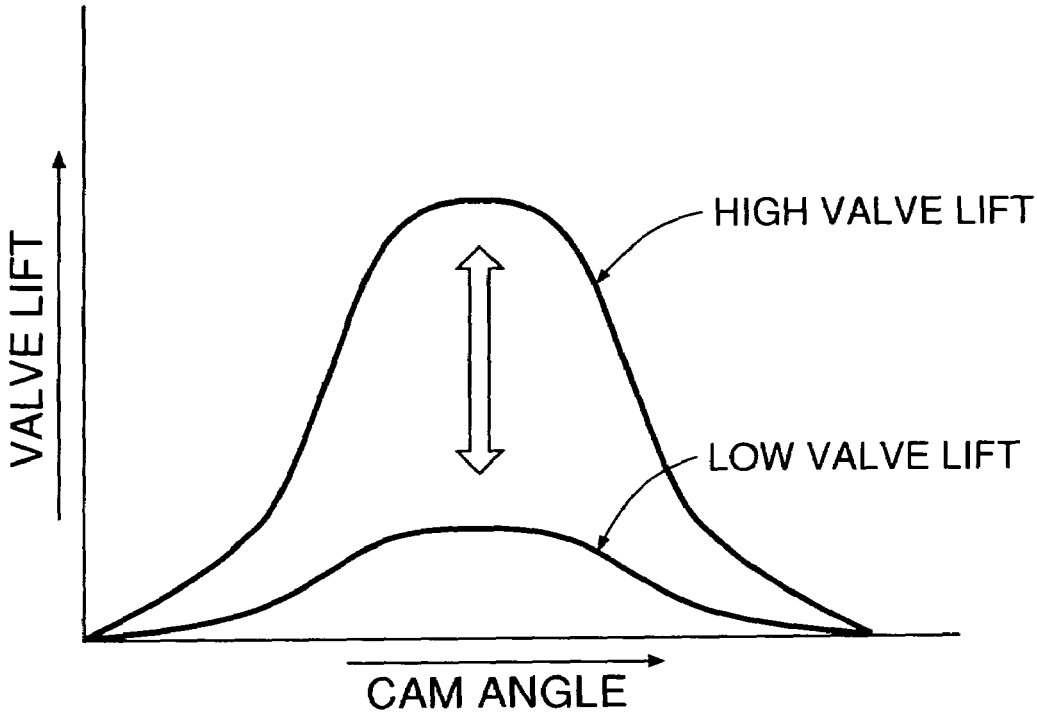
FIG. 9 is a diagram showing a valve lift curve of an engine valve. (Embodiment 1)

FIG. 9 is a diagram showing a valve lift curve of the intake valve 19. The opening angle with the high valve lift corresponding to FIG. 8A is the same as the opening angle with the low valve lift corresponding to FIG. 8B, and only the amount of lift has changed. In this way, the variable valve lifting mechanism 33 allows only the amount of lift to be changed freely without changing the opening angle of the intake valves 19.

When changing the lift of the intake valves 19 . . . by swinging the crank member 68 using the actuator motor 72, it is necessary to detect the magnitude of the lift, i.e., the rotational angle of the spindle 68*c* of the crank member 68, and feed it back for use in controlling the actuator motor 72. For that reason, the rotational angle of the spindle 68*c*of the crank member 68 is detected by the rotational angle sensor 80. To simply detect the rotational angle of the spindle 68*c* of the crank member 68, the rotational angle sensor 80 can be connected directly to the spindle 68*c*. However, since the intake efficiency changes greatly with only a slight change in the amount of valve lift in the low valve lift region, it is necessary to detect the rotational angle of the spindle 68*c* of the crank member 68 accurately and feed it back for use in controlling the actuator motor 72. On the other hand, in the high valve lift region, since the intake efficiency does not change greatly even when the amount of valve lift changes to some extent, high accuracy is not required to detect the rotational angle.

Figure 10:
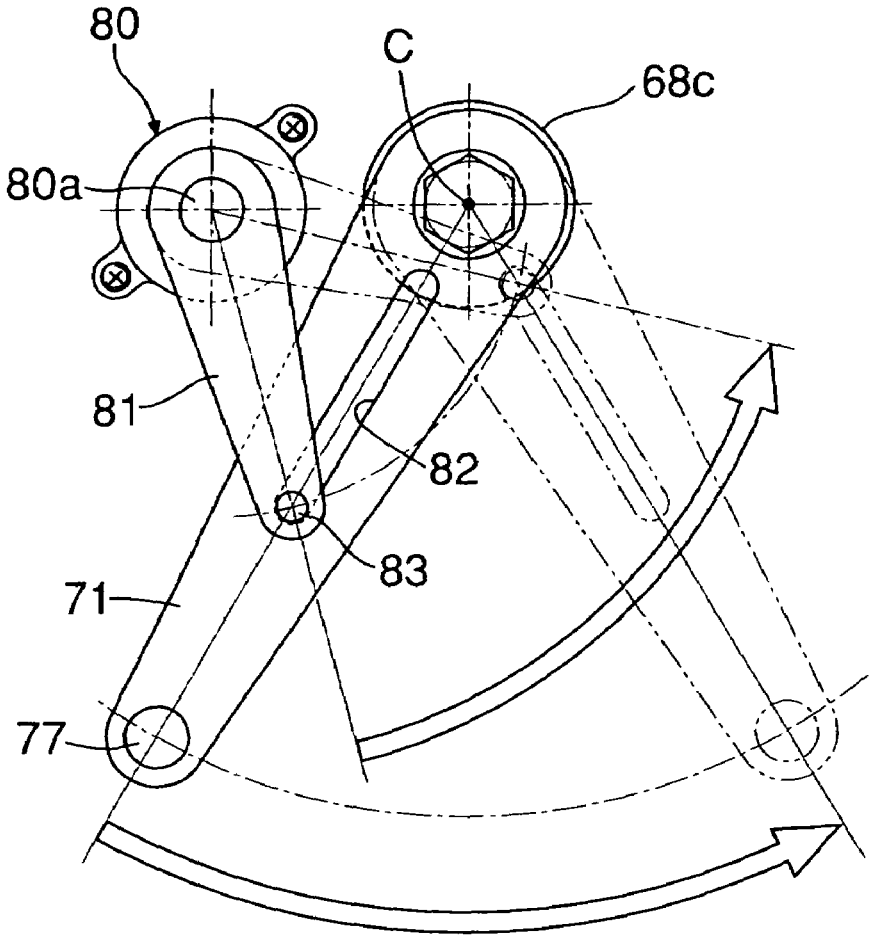
FIG. 10 is an enlarged view of essential part of FIG. 3. (Embodiment 1)

The position of the control arm 71 indicated by the solid line in FIG. 10 corresponds to the low valve lift region and the position of the control arm 71 indicated by the chain line in the anticlockwise direction away from the low valve lift region corresponds to the high valve lift position. In the low valve lift region, since the connecting shaft 83 of the sensor arm 81 fixed to the sensor shaft 80*a* of the rotational angle sensor 80 is engaged with the tip side (the side farther from the axis C) of the guide groove 82 of the control arm 71, even a slight swing of the control arm 71 results in a large swing of the sensor arm 81. This magnifies the ratio of the rotational angle of the sensor shaft 80*a* relative to the rotational angle of the crank member 68, enhancing the resolution of the rotational angle sensor 80, and thus making it possible to detect the rotational angle of the crank member 68 with high accuracy.

On the other hand, in the high valve lift region where the control arm 71 has swung to the position indicated by the chain line, since the connecting shaft 83 of the sensor arm 81 fixed to the sensor shaft 80*a* of the rotational angle sensor 80 is engaged with the base side (the side closer to the axis C) of the guide groove 82 of the control arm 71, even a large swing of the control arm 71 results in a slight swing of the sensor arm 81. This reduces the ratio of the rotational angle of the sensor shaft 80*a* relative to the rotational angle of the crank member 68, decreasing the detection accuracy of the rotational angle of the crank member 68 compared to when the valve lift is low.

Figure 11:
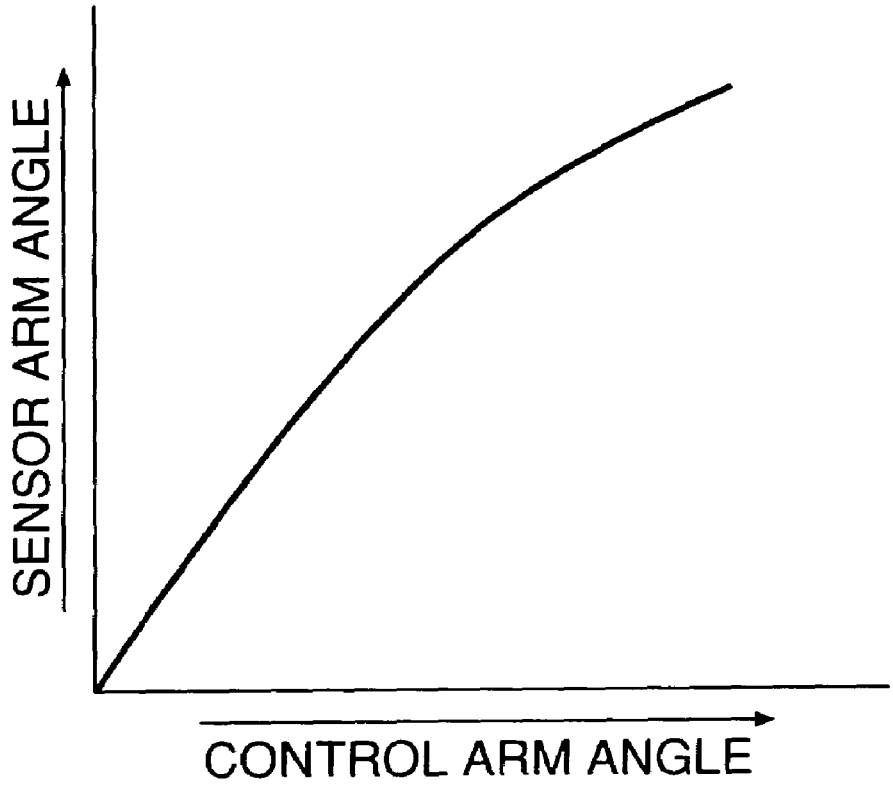
FIG. 11 is a graph showing relationship between the rotational angle of a control arm and rotational angle of a sensor arm. (Embodiment 1)

As is clear from FIG. 11, when the rotational angle of the control arm 71 increases from a low valve lift state to a high valve lift state, the detection accuracy is high at first since the rate of increase of the angle of the sensor arm 81 is high, but the rate of increase falls gradually, resulting in low detection accuracy.

In this way, without an expensive rotational angle sensor with high detection accuracy, by designing the sensor arm 81 of the rotational angle sensor 80 to be engaged with the guide groove 82 of the control arm 71, it is possible to ensure high detection accuracy in a low valve lift state where a high detection accuracy is required, and thereby contribute to cost reduction.

In this arrangement, since one end (the end closer to the spindle 68*c*) of the control arm 71 and one end (the end closer to the rotational angle sensor 80) of the sensor arm 81 are placed in proximity to each other and the guide groove 82 is formed in the end of the control arm 71, the sensor arm 81 can be made compact with reduced length. Incidentally, the formation of the guide groove 82 in the end of the control arm 71 reduces the distance from the axis C, reducing the amount of travel in the circumferential direction of the guide groove 82 as well. However, the length of the sensor arm 81 is also reduced, ensuring a sufficient rotational angle for the sensor arm 81, and thereby ensuring the detection accuracy of the rotational angle of the sensor 80.

Now, operation of the first embodiment will be described. In the variable valve lifting mechanism 33 which continuously varies the lift amounts of the intake valves 19 . . . , the first connecting portions 61*a*, 61*a* and second connecting portion 62*a* attached to the first ends of the first link arm 61 and second link arm 62, respectively, are arranged in parallel and relatively turnably connected to the second end of the rocker arm 63 having at a first end a valve connecting section 63*a* coupled to the pair of intake valves 19 . . . . The fixed support portion 61*b* on the second end of the first link arm 61 is turnably supported by the fitted spindle 67 supported by the engine body 10. The movable support portion 62*b* on the second end of the second link arm 62 is turnably supported by the movable support shaft 68*a* which is displaceable.

Thus, by varying the movable support shaft 68*a*continuously, it is possible to vary the lift amounts of the intake valves 19 . . . continuously. Moreover, since the first ends of the first and second link arms 61 and 62 are turnably connected directly to the rocker arm 63, it is possible to reduce the space required for the link arms 61 and 62, and thereby reduce the size of the valve operating system. Also, since power is transmitted directly from the valve operating cam 69 to the roller 65 of the rocker arm 63, it is possible to follow the valve operating cam 69 properly. Besides, the rocker arm 63 and the first and second link arms 61 and 62 can be placed at almost the same location along the axis of the intake camshaft 31, making it possible to reduce the size of the valve operating system along the axis of the intake camshaft 31.

The rocker arm 63 equipped with the first and second support portions 63*b* and 63*c* which turnably connect the first ends of the first and second link arms 61 and 62 as well as with a valve connecting portion 73*a* into which tappet screws 70 . . . each of which abuts on the pair of intake valves 19 . . . with adjustable advance/retract positions are screwed is configured such that the valve connecting portion 63*a* is broader in width along the axial direction of the valve operating cam 69 than the other part. This makes it possible to minimize the width of the rocker arm 63 in the direction of the rotational axis of the valve operating cam 69, again reducing the size of the valve operating system. Besides, since the first support portion 63*b* and second support portion 63*c* have the same width in the rocker arm 63, it is possible to reduce the size of the rocker arm 63 while simplifying its shape.

Since the first support portion 63*b* installed on the rocker arm 63 is formed into an appropriate U shape in such a way as to hold the roller 65 from both sides and the roller 65 is turnably supported by the first support portion 63*b*, it is possible to reduce the size of the entire rocker arm 63 including the roller 65. Moreover, the pair of first connecting portions 61*a* . . . which sandwich the first support portion 63*b* from both sides is installed on the first end of the first link arm 61, the first connecting portions 61*a* . . . are turnably connected to the first support portion 63*b* via the first connecting shaft 64, and the roller 65 is axially supported by the first support portion 63*b* via the first connecting shaft 64. Thus, it is possible to reduce the number of parts as well as the size of the valve operating system by using the common first connecting shaft 64 to turnably connect the first end of the first link arm 61 to the first support portion 63*b* at the first end of the first link arm 61 and axially support the roller 65 on the first support portion 63*b*.

The first and second connecting holes 49 and 50 which receive the first and second connecting shafts 64 and 66 which turnably connect the first ends of the first and second link arms 61 and 62, respectively, are provided in the first and second support portions 63*b* and 63*c* of the rocker arm 63 in such a way as to extend horizontally, being aligned in the opening/closing direction of the intake valves 19 . . . . Also, the first and second support portions 63*b* and 63*c* are linked by the connecting walls 63*d* at least part of which are located on the opposite side of a tangent line L from the two intake valves 19 . . . when the tangent line L is drawn to outer edges of the first and second connecting holes 49 and 50 on the side nearer to the intake valves 19 . . . . This enhances the rigidity of first and second support portions 63*b* and 63*c*.

Besides, since recesses 51 . . . are formed in the connecting walls 63*d* . . . in such a way as to face the second connecting portion 62*a* on the second end of the second link arm 62 when the second connecting portion 62*a* is at the closest point to the rocker arm 63, it is possible to displace the second connecting portion 62*a* of the second link arm 62 to the closest point to the rocker arm 63. This makes it possible to maximize the largest lift amounts of the intake valves 19 . . . while allowing the size of the valve operating system to be reduced.

Furthermore, since the narrow portions 52 . . . are formed on the connecting walls 63*d* . . . , it is possible to curb increases in the weight of the rocker arm 63 while allowing the rigidity of the rocker arm 63 to be increased by the connecting walls 63*d*.

Since the oil jets 58 . . . which supply oil to the first connecting shaft 64—the upper one of the first and second connecting shafts 64 and 66 which connect the first ends of the first and second link arms 61 and 62 to the rocker arm 63—are fixed to the engine body 10, the oil which lubricates between the rocker arm 63 and the first link arm 61—the upper one of the first and second link arms 61 and 62—flows downward to lubricate between the rocker arm 63 and the second link arm 62, i.e., the lower link arm. This makes it possible to lubricate the connecting portions between the rocker arm 63 and both the first and second link arms 61 and 62 using a simple lubricating structure with a reduced number of parts, and thereby ensure smooth valve operation.

Moreover, the rocker arm 63 is equipped with the first support portion 63*b* formed into a substantially U shape in such a way as to hold the roller 65 from both sides, the first connecting portions 61*a* . . . at the first end of the first link arm 61 are turnably connected to the first support portion 63*b* via the first connecting shaft 64 which supports the roller 65, and the oil jets 58 . . . are disposed on the engine body 10 so as to supply oil to the mating surface between the first link arm 61 and the first support portion 63*b*. This makes it possible to lubricate the journals of the roller 65 as well.

Also, since the oil jets 58 . . . are disposed on caps 45 . . . of the intake cam holders 46 . . . installed on the engine body 10 in such away as to rotatably support the intake camshaft 31 on which the valve operating cam 69 is mounted, it is possible to supply sufficient amounts of oil from the oil jets 58 . . . at a sufficiently high pressure using an oil path used to lubricate between the camshaft 31 and intake cam holders 46.

According to this example, since the oil jets 58 . . . each with a nozzle hole 58*b* at the tip of a pipe 58*a* are installed on the caps 45 . . . on the engine body 11, on both sides of the cylinder, with the tips of the pipes 58*a* . . . placed inside the rim of the combustion chamber 15 when viewed on a projection to a plane orthogonal to the axis of the cylinder, it is possible to supply oil reliably to lubrication points by bringing the tips of the oil jets 58 . . . close to the lubrication points.

The intake valves 19 . . . are biased in the valve closing direction by valve springs 24 . . . , but the rocker arm 63 is biased by the rocker arm bias springs 54 . . . separate from the valve springs 24 . . . in such a direction as to abut the roller 65 against the valve operating cam 69. Thus, even when the intake valves 19 . . . are closed, the roller 65 of the rocker arm 63 does not leave the valve operating cam 69. This increases the control accuracy of the valve lift amounts even when the intake valves 19 . . . are slightly opened.

The rocker arm bias springs 54 . . . are coiled tortional springs which surround one of the fixed spindle 67 and the movable shaft 68*a*—the fixed spindle 67, in this example—which turnably support the fixed support the second ends of the first and second link arms 61 and 62. This makes it possible to reduce the installation space of the rocker arm bias springs 58 . . . , thereby reducing the size of the valve operating system.

Moreover, since the pair of supporting bosses 53 which support the fixed spindle 67 are mounted on the supporting walls 44*a* . . . of the intake cam holders 46 . . . of the engine body 10 so as to sandwich the second end of the first link arm 61 from both sides and the rocker arm bias springs 54 . . . are mounted between the engine body 10 and rocker arm 63 in such a way as to surround the supporting bosses 53, 53*s*, it is possible to lay out the rocker arm bias springs 54 . . . compactly by limiting the movement of the fixed support portion 61*b* on the second end of the first link arm 61 with the pair of supporting bosses 53, 53 and keeping compression of the rocker arm bias springs 54 . . . from affecting the fixed spindle 67.

The cylindrical fixed support portion 61*b* is installed on the second end of the first link arm 61, being turnably supported by a fixed spindle 67, with its outer circumference placed within the outer circumference of the rocker arm bias springs 54 . . . when viewed laterally. At axially opposite ends of the fixed support portion 61*b*, the plurality of protrusions 56, 57 . . . , and so on, spaced circumferentially from each other, are installed to prevent the rocker arm bias springs 54 . . . from falling toward the fixed support portion 61b. Thus, it is possible to prevent the rocker arm bias springs 54 . . . from falling forward and increase support rigidity of the fixed support portion 61*b* without increasing the size of the fixed support portion 61*b*.

Besides, since the protrusions 56 and 57 . . . are kept clear of the working area of the second link arm 62, it is possible to secure a sufficiently large working area for the second link arm 62 even though the protrusions 56, 57 and so on are installed on the fixed support portion 61*b*.

Also, the variable valve lifting mechanism 33 comprises the crank member 68 on opposite ends of the connection plate 68*b*, where the movable shaft 68*a* and the spindle 68*c* whose axis is parallel to the movable shaft 68*a* stick out from the crank member 68, and the spindle 68*c* is turnably supported on the head cover 16 of the engine body 10. Thus, by turning the crank member 68 on the axis of the spindle 68*c*, it is possible to displace the movable shaft 68*a* easily and simplify the mechanism for displacing the movable shaft 68*a* by the actuator motor 72.

Embodiment 2

Figure 12:
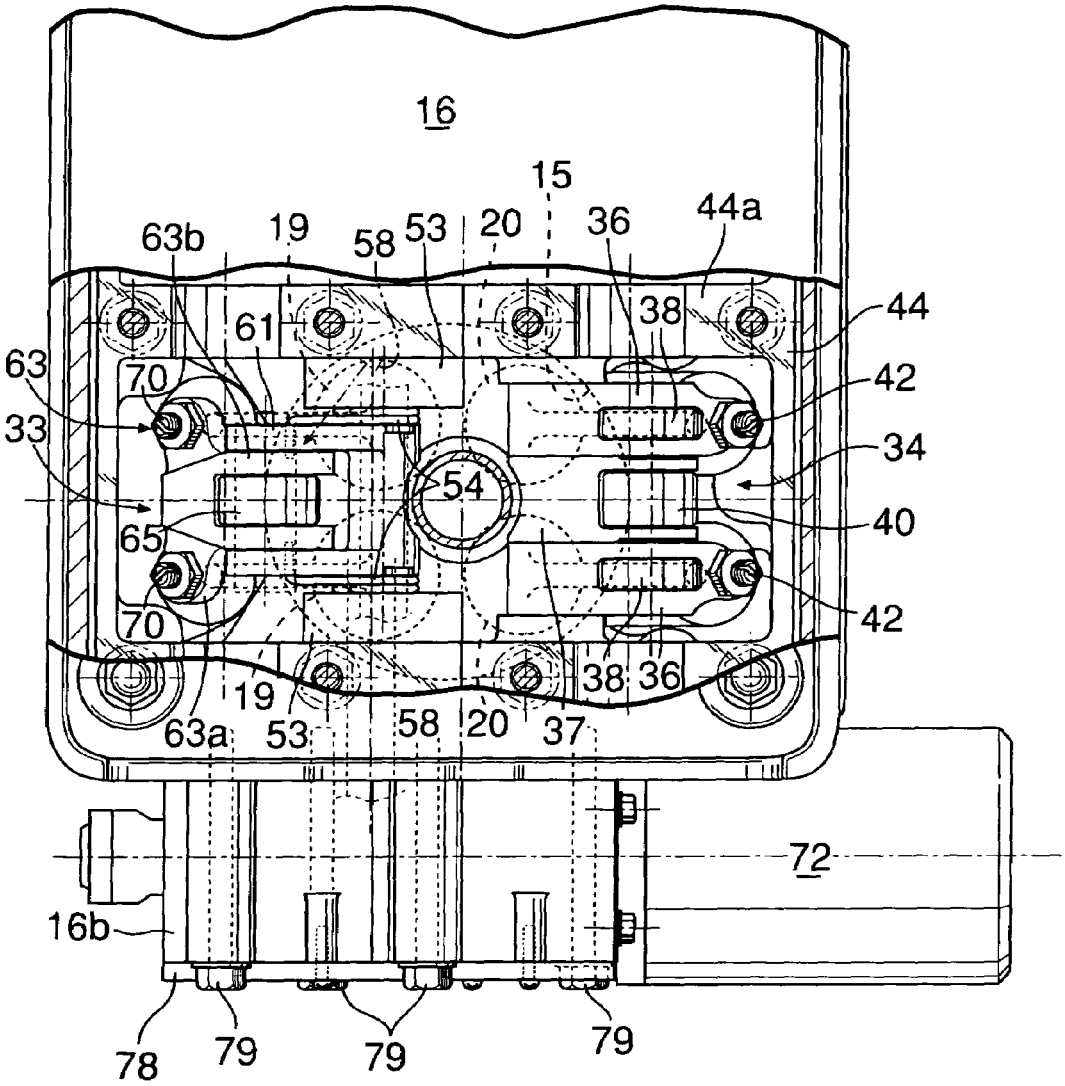
FIG. 12 is a sectional view according to a second embodiment and corresponding to FIG. 2. (Embodiment 2)

FIG. 12 shows a second embodiment of the present invention. Components corresponding to those in the first embodiment are denoted by the same reference numerals as those in the first example.

An oil jet 58 serving as oil supply means is fixed to the engine body 10 to supply oil to a first connecting shaft 64 (see the first embodiment) which connects a first end of a first link arm 61 to a second end of a rocker arm 63. According to the second example, the oil jet 58 is installed on a cap 45 on the engine body 10, on one side of the cylinder, with the tip of a pipe 58*a* placed inside the rim of a combustion chamber 15 when viewed on a projection to a plane orthogonal to the axis of the cylinder (plane parallel to the paper in FIG. 12).

According to the second embodiment, it is possible to reduce the number of oil jets 58 and supply oil reliably to lubrication points by bringing the tips of the oil jets 58 close to the lubrication points from one side of the cylinders.

The present invention is not limited to the embodiments described above and allows various design changes without departing from the scope of the present invention set forth in the appended claims.

The invention claimed is:

1. An engine valve operating system comprising a rocker arm which has a valve connecting portion linked and connected to an engine valve and a cam-abutting portion to abut a valve operating cam; a first link arm with one end turnably connected to the rocker arm via a first connecting shaft and the other end turnably supported at a fixed position on an engine body; a second link arm with one end turnably connected to the rocker arm via a second connecting shaft disposed side by side in a vertical arrangement with the first connecting shaft and the other end turnably supported by a movable shaft which is displaceable; drive means connected to the movable shaft, being ready to displace the movable shaft in order to vary a lift amount of the engine valve continuously; and oil supply means which is fixed to the engine body and supplies oil to the upper one of the first and second connecting shafts, wherein the rocker arm is equipped with a support portion formed into a substantially U shape so as to sandwich a roller which is the cam-abutting portion from opposite sides; the one end of the first link arm is turnably connected to the support portion via the first connecting shaft which supports the roller; and the oil supply means is disposed on the engine body so as to supply oil to a mating surface between the first link arm and the support portion.

2. The engine valve operating system according to claim 1, wherein the oil supply means is disposed on cam holders installed on the engine body so as to rotatably support a camshaft on which the valve operating cam is mounted.

3. The engine valve operating system according to claim 2, wherein the oil supply means which is formed of oil jets, each with a nozzle hole provided at the tip of a pipe, is disposed on opposite sides of each cylinder on the engine body.

4. The engine valve operating system according to claim 2, wherein the oil supply means which is formed of the oil jet with the nozzle hole provided at the tip of the pipe is disposed on one side of each cylinder on the engine body.

5. The engine valve operating system according to claim 1, wherein the oil supply means which is formed of oil jets, each with a nozzle hole provided at the tip of a pipe, is disposed on opposite sides of each cylinder on the engine body.

6. The engine valve operating system according to claim 1, wherein the oil supply means which is formed of the oil jet with the nozzle hole provided at the tip of the pipe is disposed on one side of each cylinder on the engine body.

* * * * *